US007516779B1

(12) United States Patent
Marcus

(10) Patent No.: US 7,516,779 B1
(45) Date of Patent: Apr. 14, 2009

(54) CONCENTRIC TUBE OIL COOLER

(75) Inventor: Arnold Marcus, Orange, CT (US)

(73) Assignee: Proliance International Inc., New Haven, CT (US)

( * ) Notice: Subject to any disclaimer, the term of this patent is extended or adjusted under 35 U.S.C. 154(b) by 272 days.

(21) Appl. No.: 11/376,525

(22) Filed: Mar. 15, 2006

(51) Int. Cl.
*F28F 9/22* (2006.01)

(52) U.S. Cl. ..... 165/140; 165/174

(58) Field of Classification Search ..... 165/140, 165/174

See application file for complete search history.

(56) References Cited

U.S. PATENT DOCUMENTS

| | | | |
|---|---|---|---|
| 4,004,634 | A | 1/1977 | Habdas |
| 4,553,586 | A | 11/1985 | Lardner |
| 4,561,498 | A | 12/1985 | Nowobilski et al. |
| 4,936,381 | A | 6/1990 | Alley |
| 5,062,474 | A | 11/1991 | Joshi |
| 5,067,561 | A | 11/1991 | Joshi et al. |
| 5,123,483 | A | 6/1992 | Tokutake et al. |
| 5,186,245 | A | 2/1993 | Peters |
| 5,186,248 | A | 2/1993 | Halstead |
| 6,332,495 | B1 | 12/2001 | Jamison et al. |
| 6,341,649 | B1 | 1/2002 | Joshi et al. |
| 6,662,863 | B2 | 12/2003 | Igami et al. |
| 6,904,963 | B2 | 6/2005 | Hu |

FOREIGN PATENT DOCUMENTS

JP 11062587 A * 3/1999

* cited by examiner

*Primary Examiner*—Leonard R Leo
(74) *Attorney, Agent, or Firm*—DeLio & Peterson, LLC; Peter W. Peterson

(57) ABSTRACT

A radiator and oil cooler combination for an internal combustion engine includes a concentric type oil cooler in the radiator inlet or outlet tank. A baffle directs coolant flow around the oil cooler. In one embodiment, the baffle is between an inner surface of the outlet radiator tank housing and the outer wall of the oil cooler forming a barrier substantially filling the space therebetween. The baffle is located away from the ends of the oil cooler, intermediate the length thereof, and intermediate the length of the outlet radiator tank containing the tube openings. In another embodiment, the baffle is between and spaced from the oil cooler and the radiator core tube openings. The baffle extends along at least a portion of the length of the outlet radiator tank containing the tube openings and overlaps at least a portion of the length of the oil cooler. In a further embodiment, the baffle is located in the radiator tank near one end of the oil cooler and has an opening spaced from the oil cooler outer wall.

20 Claims, 11 Drawing Sheets

CONCENTRIC TUBE OIL COOLER

BACKGROUND OF THE INVENTION

1. Field of the Invention

This invention relates to an automatic transmission fluid cooling system for internal combustion engines used in trucks and other motor vehicles and, in particular, to a cooling system utilizing a concentric tube oil cooler in combination with a radiator.

2. Description of Related Art

Radiators for automobiles have evolved in recent years from soldered units made of copper and brass to mechanically assembled units having brazed aluminum cores and plastic tanks. Common to the two types of radiators has been an oil cooler installed in the outlet radiator tank for the purpose of cooling automatic transmission fluid by the engine coolant. Occasionally, automobile or light truck radiators are made with a transmission oil cooler in one radiator tank and an engine oil cooler of similar construction in the other tank. Such oil coolers have typically been either of the concentric tube type or of the stacked plate type. The stacked plate type oil cooler is typically higher cost, usually being made of stainless steel, and has higher performance than the concentric tube type oil cooler of similar size. The concentric tube type oil cooler typically consists of two concentric brass tubes welded together at their ends and has a lanced-offset inner fin between them for turbulation of the transmission fluid or oil.

While motor vehicle radiator design changes in recent years have resulted in lower cost and better-controlled product quality, e.g., by the use of brazed aluminum which allows the use of more highly automated and more consistent manufacturing processes, the oil cooler remains the single most expensive component of a radiator. There is a great need, both for original equipment and aftermarket radiators, to reduce the cost and improve the performance of this component, the design and installation of which has remained unchanged for many years.

SUMMARY OF THE INVENTION

Bearing in mind the problems and deficiencies of the prior art, it is therefore an object of the present invention to provide an improved system and method for cooling a concentric oil cooler in a motor vehicle radiator tank.

It is another object of the present invention to provide a baffle for a concentric oil cooler in a radiator tank that improves circulation of coolant in the tank to cool the oil flowing through the oil cooler.

A further object of the present invention is to provide an improved baffle and concentric oil cooler combination that may be easily assembled in a radiator tank and that provides cost savings in manufacture.

Still other objects and advantages of the invention will in part be obvious and will in part be apparent from the specification.

The above and other objects, which will be apparent to those skilled in the art, are achieved in the present invention which is directed to a radiator and oil cooler combination for an internal combustion engine comprising a radiator core comprising a plurality of tubes and fins between the tubes, an inlet radiator tank and an outlet radiator tank. The inlet radiator tank has an engine coolant inlet and is connected along a side of the tank to the tubes at one end of the radiator core, so as to permit coolant flow entering from the coolant inlet to pass into the radiator core tubes. The outlet radiator tank has an engine coolant outlet and is connected along a side thereof to the tubes at the other end of the radiator core, with openings of the tubes extending along a length of the outlet radiator tank side. The outlet radiator tank permits coolant flow entering from the radiator core tubes to pass through the coolant outlet. The invention also includes an oil cooler within the outlet radiator tank comprising inner and outer concentric tubes sealed to each other at opposite ends thereof. Fluid connections through the outer concentric tube allow oil to enter and exit the oil cooler. The oil may flow in the oil cooler between the inner and outer tubes, and the coolant may flow along an outer wall of the outer tube and through the inside of the inner concentric tube along an inner wall thereof. The invention also includes a baffle between an inner surface of the outlet radiator tank housing and the outer wall of the oil cooler forming a barrier substantially filling the space therebetween. The baffle is located away from the ends of the oil cooler, intermediate the length thereof, and intermediate the length of the outlet radiator tank containing the tube openings.

In the method of use of the invention, oil is flowed through the oil cooler and engine coolant is flowed from the inlet radiator tank in a single pass through the tubes of the radiator core to the outlet radiator tank. Coolant entering from the radiator core tubes on one side of the baffle is directed along the oil cooler outer wall in a direction away from the baffle and then entirely through the inside of the inner concentric tube along the inner wall thereof and out the outlet radiator tank outlet. Coolant entering from the radiator core tubes on the other side of the baffle is directed along the oil cooler outer wall in a direction away from the baffle and out the outlet radiator tank outlet, without passing through the inside of the inner concentric tube, to cool the oil flowing through the oil cooler.

The baffle may have first and second portions substantially sealing with each other, whereby the sealed portions form a substantially flat perpendicular barrier filling the space between the inner surface of the tank housing and the outer surface of the oil cooler. One of the baffle portions may be integral with the tank housing. One of the baffle portions may have a slot to engage an edge of the other of the baffle portions.

The baffle may comprise a resilient, single piece having an opening for the oil cooler and a slit between the opening and an outer edge of the piece to enable the baffle to be positioned around the oil cooler. The radiator and oil cooler combination may further include a baffle reinforcement member engageable with the baffle over the slit to reinforce the baffle.

In a modification of the invention, the oil cooler and baffle may be placed in the inlet tank in a position similar to that described for the outlet tank. In such case, a portion of coolant entering from the inlet radiator tank coolant inlet is directed through the inside of the inner concentric tube along the inner wall thereof and then along the oil cooler outer wall and out the radiator core tubes on one side of the baffle, and another portion of coolant entering from the inlet radiator tank coolant inlet is directed along the oil cooler outer wall and out the radiator core tubes on the other side of the baffle, without passing through the inside of the inner concentric tube.

In another aspect, the present invention is directed to a radiator and oil cooler combination for an internal combustion engine comprising a radiator tank having an engine coolant outlet, with the radiator tank being connected along a side thereof to radiator core tubes. Openings of the tubes extend along a length of the outlet radiator tank side, so that the radiator tank permits coolant flow entering from the radiator core tubes to pass through the coolant outlet. This aspect of the invention also includes an oil cooler within the radiator tank comprising inner and outer concentric tubes sealed to each other at opposite ends thereof, with fluid connections through the outer concentric tube to allow oil to enter and exit the oil cooler. The oil may flow in the oil cooler between the inner and outer tubes, and the coolant may flow along an outer wall of the outer tube and through the inside of the inner concentric tube along an inner wall thereof. The invention also includes a baffle between and spaced from the oil cooler and the radiator core tube openings. The baffle extends along at least a portion of the length of the outlet radiator tank containing the tube openings and overlaps at least a portion of the length of the oil cooler.

In the method of use of the invention, oil is flowed through the oil cooler and engine coolant is flowed from the radiator core tubes to the radiator tank, whereby the baffle directs substantially all of the coolant entering from the core tubes toward one end of the radiator tank and then directs a portion of the coolant through the inside of the inner concentric tube along the inner wall thereof and another portion of the coolant along the oil cooler outer wall, to cool the oil flowing through the oil cooler.

In a modification of this aspect of the invention, the oil cooler and baffle may be placed in the inlet tank in a position similar to that described for the outlet tank. In such case, the baffle directs substantially all of the coolant entering from the radiator tank engine coolant inlet toward one end of the radiator tank such that a portion of the coolant is directed through the inside of the inner concentric tube along the inner wall thereof and another portion of the coolant is directed along the oil cooler outer wall.

In another aspect, the present invention is directed to a radiator and oil cooler combination for an internal combustion engine comprising a radiator tank having an engine coolant outlet, with the radiator tank being connected along a side thereof to radiator core tubes. Openings of the tubes extend along a length of the outlet radiator tank side, so that the radiator tank permits coolant flow entering from the radiator core tubes to pass through the coolant outlet. The invention includes an oil cooler within the radiator tank comprising inner and outer concentric tubes sealed to each other at opposite ends thereof, with fluid connections through the outer concentric tube to allow oil to enter and exit the oil cooler. The oil may flow in the oil cooler between the inner and outer tubes, and the coolant may flow along an outer wall of the outer tube and through the inside of the inner concentric tube along an inner wall thereof. This aspect of the invention also includes a baffle located in the radiator tank near one end of the oil cooler. The baffle has an opening spaced from the oil cooler outer wall.

In the method of use of the invention, oil is flowed through the oil cooler and engine coolant is flowed from the radiator core tubes to the radiator tank, whereby the spacing between the baffle opening and the outer wall restricts coolant flow therethrough so as to permit a portion of the coolant entering from the radiator core tubes to pass between the oil cooler and the opening and out the coolant outlet while forcing the other portion of the coolant entering from the radiator core tubes to flow away from the baffle opening, along the oil cooler outer wall and through the inside of the inner concentric tube along the inner wall and out the baffle opening and coolant outlet.

The baffle may comprise a plate located beyond the end of the oil cooler, toward the coolant outlet of the tank. The baffle opening may be the same as, smaller than, or larger than a diameter of the oil cooler.

The baffle may comprise a plate located between the ends of the oil cooler, with the baffle opening being larger than a diameter of the oil cooler.

Alternatively, the baffle may comprise a tube extension attached to the tank coolant outlet, with the baffle opening comprising a free end of the tube extension. The baffle opening may be the same as, smaller than, or larger than a diameter of the oil cooler. If larger, the baffle tube extension free end may overlap an end of the oil cooler.

In a modification of this aspect of the invention, the oil cooler and baffle may be placed in the inlet tank in a position similar to that described for the outlet tank. In such case, the spacing between the baffle opening and the outer wall restricts coolant flow therethrough so as to permit a portion of the coolant entering from the radiator tank engine coolant inlet to pass between the oil cooler and the opening, along the oil cooler outer wall and out the radiator core tubes while forcing the other portion of the coolant entering from the radiator tank engine coolant inlet to through the inside of the inner concentric tube along the inner wall and out the radiator core tubes.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENTS

In describing the preferred embodiment of the present invention, reference will be made herein to FIGS. 1-14 of the drawings in which like numerals refer to like features of the invention.

Figure 1:
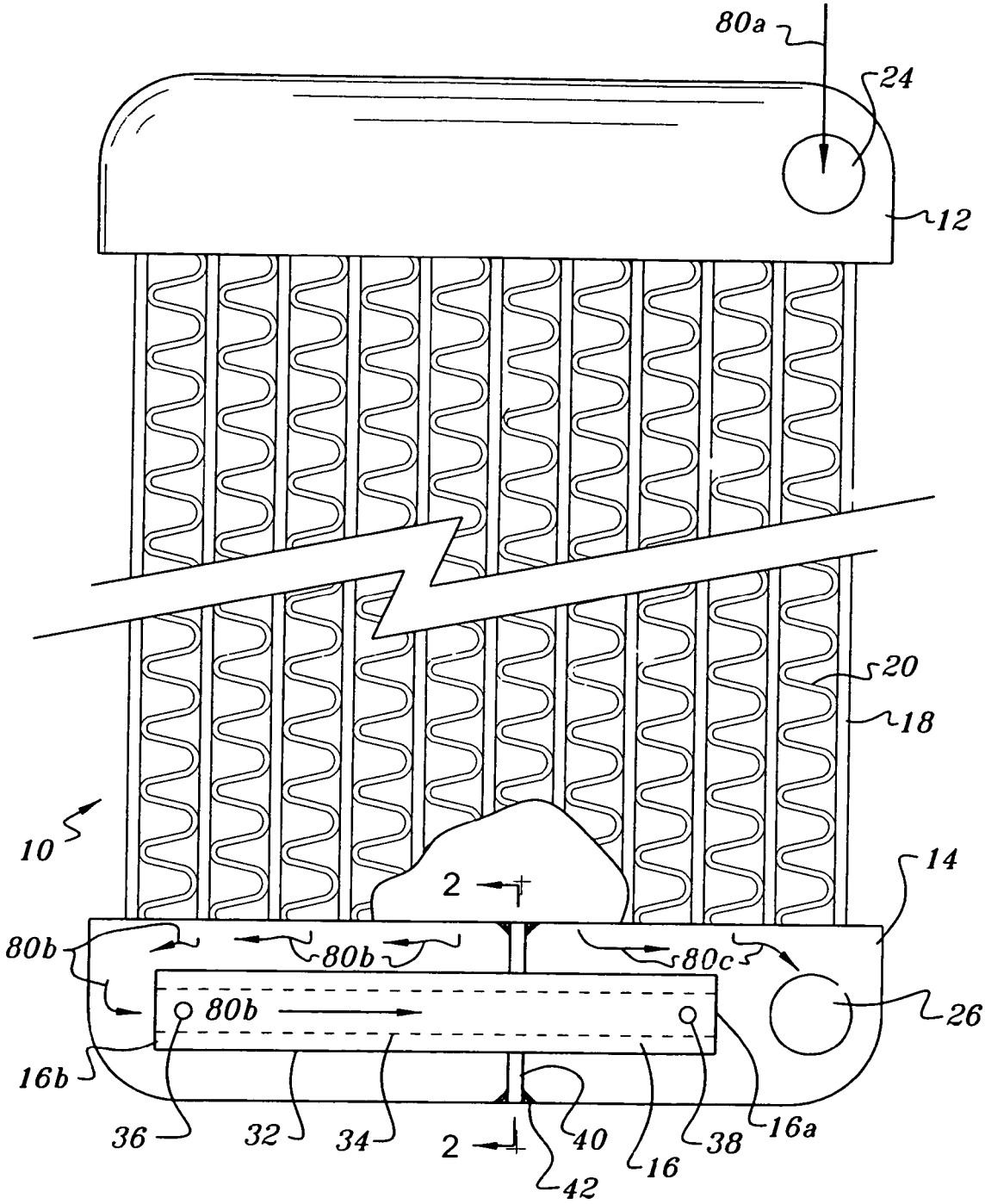
FIG. 1 is a front elevational view, partially in section, of a first embodiment of the preferred motor vehicle radiator, oil cooler and baffle combination of the present invention.
Figure 2:
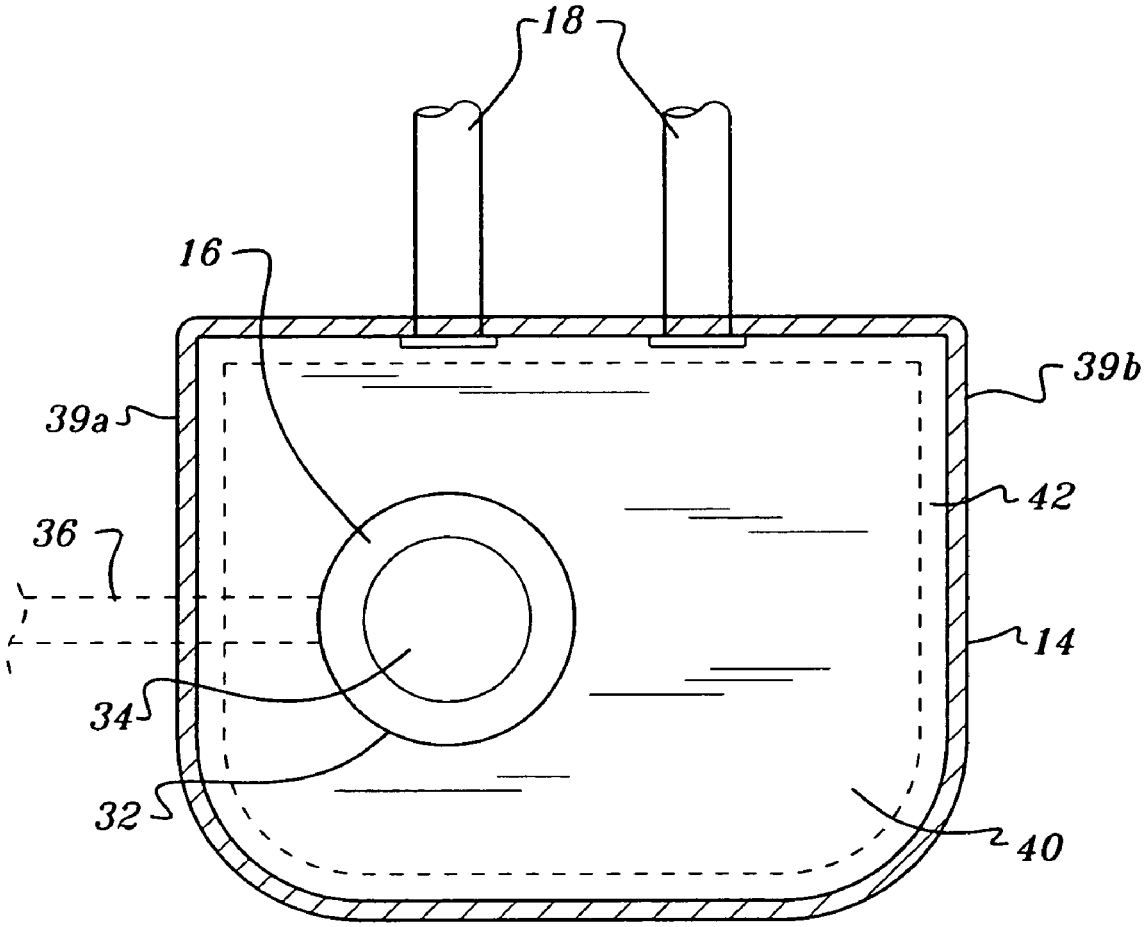
FIG. 2 is a right side sectional view, along lines 2-2 of FIG. 1, of the first embodiment oil cooler and baffle mounted in the radiator outlet tank.
Figure 3:
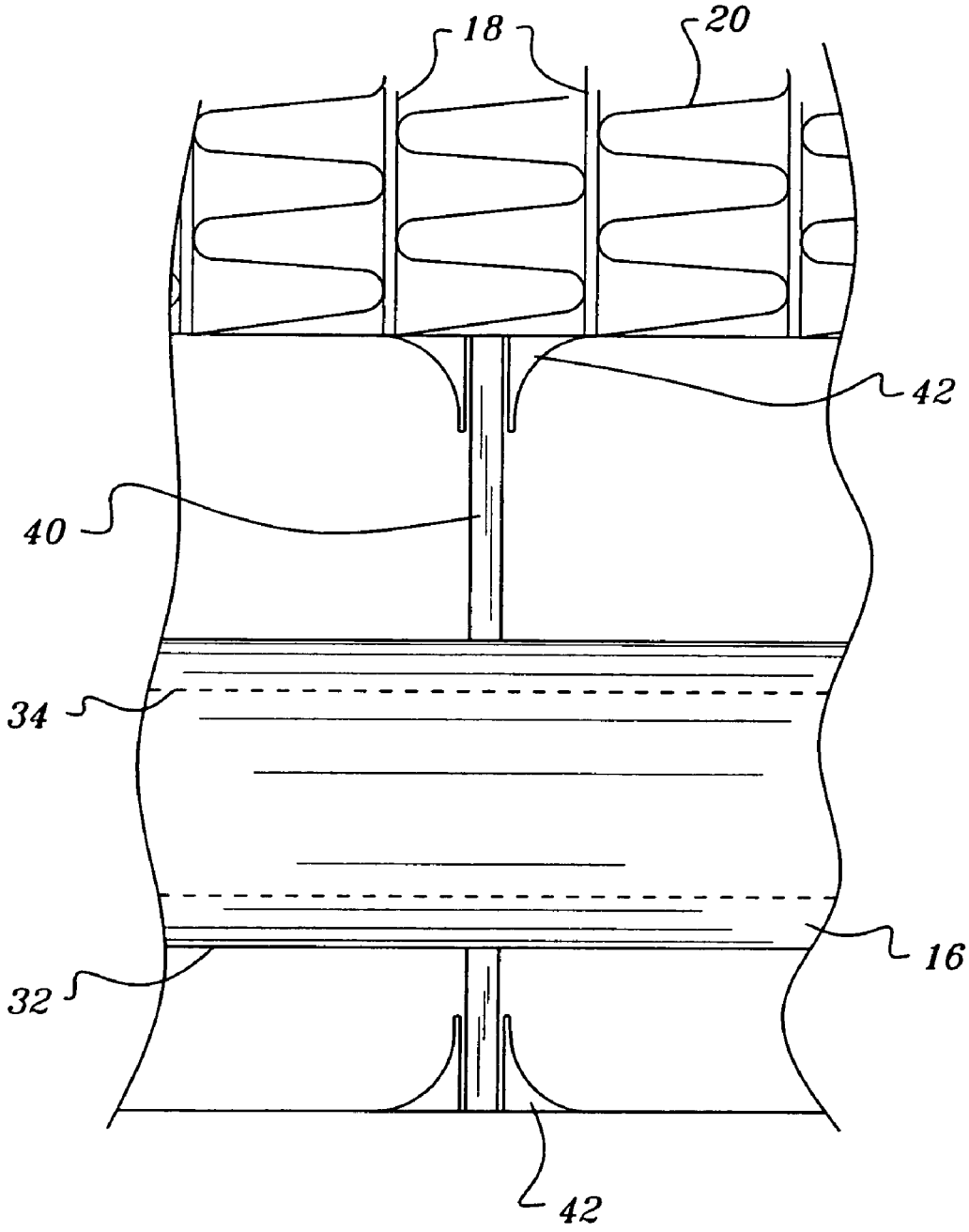
FIG. 3 is a front sectional view showing an enlarged view of the baffle and baffle slot of the oil cooler embodiment of FIG. 1.

The first embodiment of the preferred motor vehicle radiator and oil cooler combination of the present invention, shown in FIGS. 1-3, includes a radiator core 10 disposed between an inlet tank 12 and an outlet tank 14 with an oil cooler 16 located internal to the outlet tank. The inlet tank 12 has on one end thereof a coolant inlet 24 and the outlet tank 14 has on one end thereof a coolant outlet 26. Radiator core 10 is preferably made up of a plurality of two row-deep core tubes 18 extending across the face of the core, which tubes transfer the radiator coolant from the inlet tank 12 to the outlet tank 14. These core tubes may have opposite tube ends of cylindrical, oval, or of other cross sectional design which mate with header plates on the radiator tanks. Fins 20 are attached between the core tubes to transfer heat from the radiator coolant to ambient air passing between the fins.

As shown in the end view of FIG. 2, core tubes 18 pass through the header wall along the lower side of the inlet tank 12 and the upper side of the outlet tank 14, and extend along substantially the entire length of each tank. Leak-tight joints are formed between the core tubes 18 and the inlet tank 12 and outlet tank 14. The core tubes may be attached to the tanks by any known means, one method of connection being the attachment of the core tubes to a header on the outlet tank utilizing grommets in tube-to-header joints described in U.S. Pat. No. 6,460,610, the disclosure of which is hereby incorporated by reference. Alternately the core tube connections may be made to a header by the welding and soldering method described in U.S. Pat. No. 5,407,004, in the disclosure of which is hereby incorporated by reference. The tube connections may be made to the tanks with or without the implement of a header formed separately from the outlet tank. These core tube connections allow the coolant to travel in a single pass from inlet tank 12 through all of the core tubes 18 and into outlet tank 14. The preferred single pass radiator of the present invention is contrasted with multiple pass radiators in which the opposing tanks are segmented so that the coolant travels multiple times through the core, each time in through separate tubes and in opposite direction between the different opposing tank segments.

In the preferred oil cooler configuration of the present invention, oil cooler 16 is located internal to the outlet tank 14 and is positioned so that the longitudinal axis of the oil cooler lies along the length of the tank (i.e., the width of the radiator) and the oil cooler is essentially parallel with proximate to the front wall of the outlet tank (FIG. 2). The oil cooler is constructed with an outer tubular wall 32 concentric with an inner tubular wall 34, and is sealed at each end 16*a*, 16*b* between the inner wall and the outer wall so that the oil to be cooled flows from an inlet tube 36 near end 16*b* to an outlet tube 38 near end 16*a*. Inner fins (not shown) may be provided between the inner and outer walls for turbulation of the oil to improve cooling thereof. The interior aperture portion of the oil cooler is open at each end so the radiator coolant may flow externally to the oil cooler along the outside of outer wall 32 as well as internally along the inside of inner wall 34. The reference to oil as the liquid being cooled is intended to refer not only to automatic transmission fluid and engine oil as discussed above, but also to any liquid that is to be cooled by the oil cooler of the present invention.

The oil cooler 16 of the first embodiment shown is held in place by baffle 40, the inlet tube 36 and the outlet tube 38. The oil cooler is located proximate front wall 39*a* of the outlet tank where the inlet tube and the outlet tube pass through and are externally sealed with the front wall to form a leak-tight seal. Baffle 40 is planar in configuration and is normal to the longitudinal axis of the oil cooler to completely fill and seal the space between the outer surface of the oil cooler and the inner surface of the tank, thereby preventing coolant flow from one end of the tank to the other except through the interior tube of the oil cooler. The baffle is located at a mid-portion of the oil cooler, away from ends 16*a*, 16*b*. Baffle 40 is captured and held in place along its entire outer edge by mounting in baffle slot 42 extending around the interior surface of the walls of tank 14. In the case of a plastic tank, the baffle slot may be molded in and integral with the tank itself. In the embodiments shown herein, the baffle may be made of plastic or other suitable material.

Figure 4:
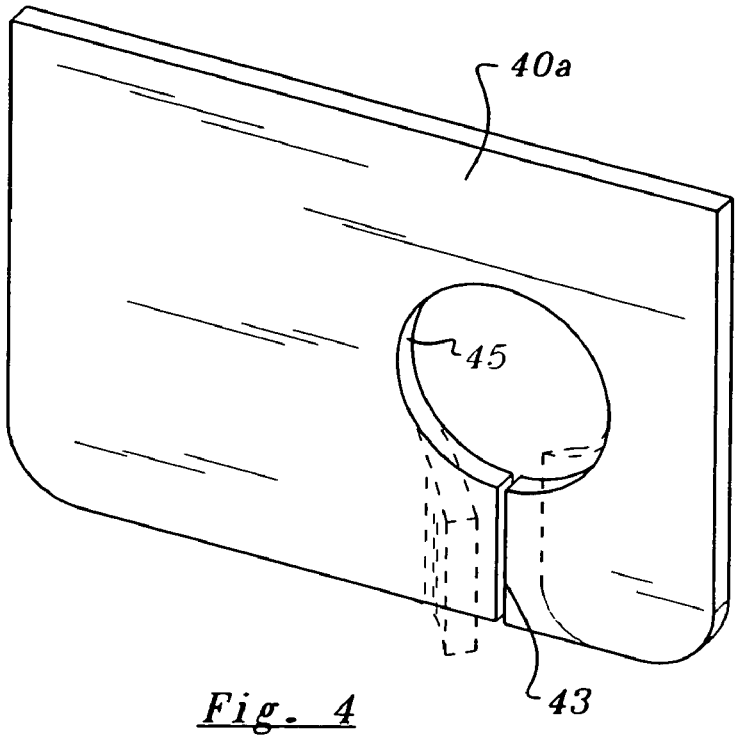
FIG. 4 is a perspective view of one embodiment of the oil cooler baffle shown in FIGS. 1 and 3.

Baffle 40 may be constructed and used in several ways. As shown in FIGS. 1-3, the baffle is a single element fitting tightly around the outer surface of the oil cooler. In FIG. 4, the baffle 40*a* comprises a resilient, single piece having an opening 45 sized to mate with the oil cooler and a slit 43 between the opening and an outer edge. The edges of the slit are pushed in opposite directions as shown in phantom lines, the opening 45 of the baffle is positioned around the oil cooler, and the edges are released so that the baffle returns to its original flat position with the edges of the slit realigned. The oil cooler 16 and baffle 40*a* are positioned within the radiator coolant tank and the exterior edge of the baffle is positioned within the baffle slot 42, where the baffle slot holds the baffle from reopening.

Figure 5:
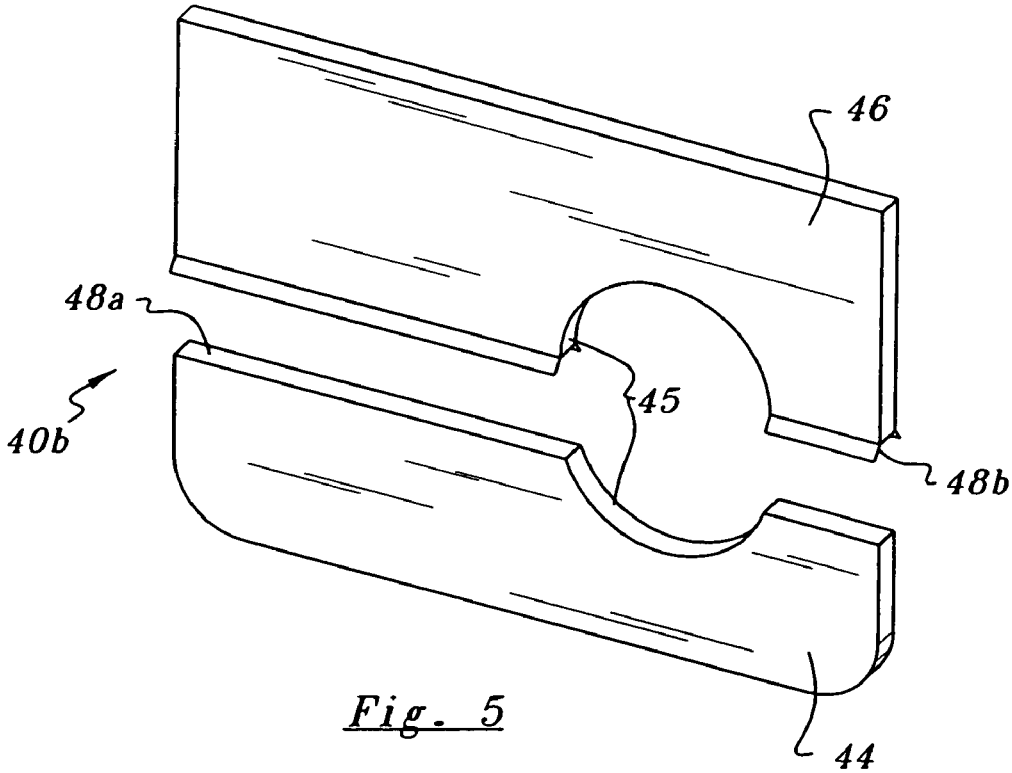
FIG. 5 is a perspective view of another embodiment of the oil cooler baffle shown in FIGS. 1 and 3.

In a modification shown in FIG. 5, baffle 40*b* may consist of two separate pieces, a lower portion 44 and an upper portion 46 each forming a portion of the oil cooler opening 45, where the upper portion has a lower slot 48*b* to engage the upper edge 48*a* of the lower portion. One of the portions, for example, the lower portion, may be placed in the baffle slot 42 (see FIG. 3) or, alternatively, may be made integral with the outlet tank. With the first baffle portion in place, the oil cooler is installed in the outlet tank, and subsequently the other baffle portion is inserted into its position so that edge 48*a* engages slot 48*b* and held in place by baffle slot 42.

Figure 6:
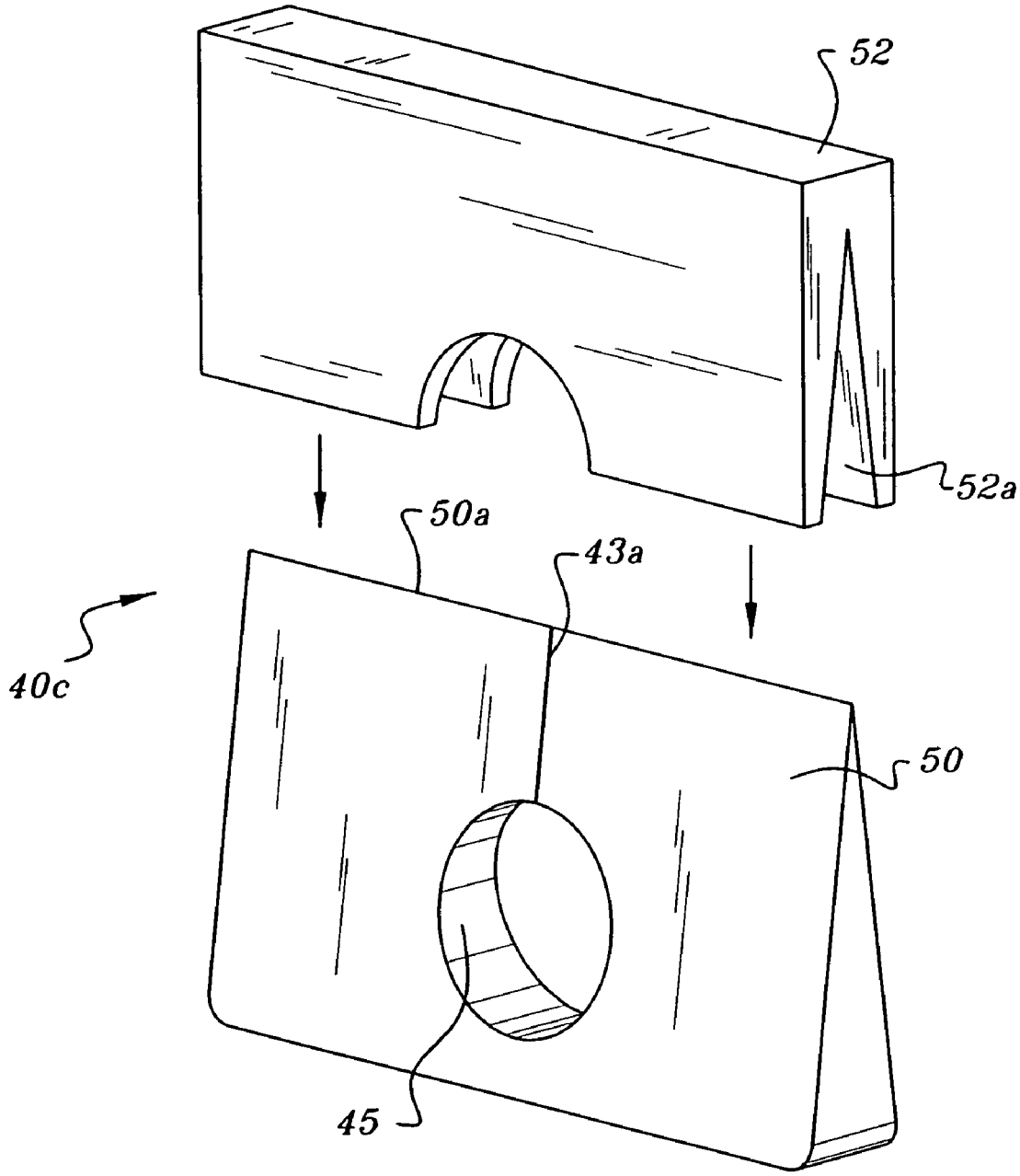
FIG. 6 is a perspective view of yet another embodiment of the oil cooler baffle shown in FIGS. 1 and 3.

FIG. 6 shows yet another modification of baffle 40*c* where lower portion 50 has a wedge-shaped cross-section with a sharp upper edge 50*a* and separate upper portion 52 has a female wedge-shaped opening 52*a* along the lower edge. Lower portion 50 is resilient and contains opening 45 and slit 43*a* extending from the opening to the upper edge 50*a* thereof. Upper portion 52 has a portion of the oil cooler opening 45 formed therein. One portion, for example, lower portion 50, is positioned or integrally formed in the outlet tank. The edges of slit 43*a* are pushed in opposite directions, the oil cooler is placed within the opening of the lower portion 50, and the slit edges are realigned. The wedge opening 52*a* of upper portion 52 is then pushed onto the sharper edge 50*a* of the lower wedge portion 50 to reinforce the lower baffle portion once the oil cooler 16 is in place.

In operation of the cooling system of FIGS. 1 to 3, hot coolant 80*a* flows into the inlet tank 12 from the internal combustion engine through the coolant inlet 24 and then is distributed for downward flow in a single pass through core tubes 18. The temperature differential between the core tubes and core fins 20 and the external ambient cooling air flowing through the fins causes a continuous transfer of heat from the coolant to the air. The now-cooled coolant continues downward into outlet tank 14 where the flow pattern is directed by the internal configuration of the oil cooling system elements.

In the first embodiment of the invention shown in FIGS. 1-3, baffle 40 prevents a portion of the coolant exiting from core tubes 18 from flowing directly to outlet 26. Instead, the baffle directs that portion of coolant 80*b* entering from the core tubes 18 at one end of the outlet tank 14, on the side of the baffle opposite coolant outlet 26, toward the interior aperture of the oil cooler 16 on that same end 16*b*. The coolant then flows through the center aperture of the oil cooler in the direction toward the opposite end 16*a* of the oil cooler, and toward coolant outlet 26. This permits heat transfer from the hot oil in the oil cooler to the cooler coolant in the radiator outlet tank to take place along the outside portion of the outer wall 32 of the oil cooler on that side of baffle 40 and along the entire length of inner wall 34 of the oil cooler. Baffle 40 also causes the portion of coolant 80*c*, entering from core tubes 18 at the same side of the baffle that the outlet tank 14 is located, to flow along the outer wall 32 of the oil cooler 16 and then out the coolant outlet 26. The flow of coolant 80*b* through the interior aperture of the oil cooler prevents coolant 80*c* from passing through the interior aperture. The location of baffle 40 with respect to the length of the tank and the length of the oil cooler may be determined without undue experimentation by the needs of the system.

Figure 7:
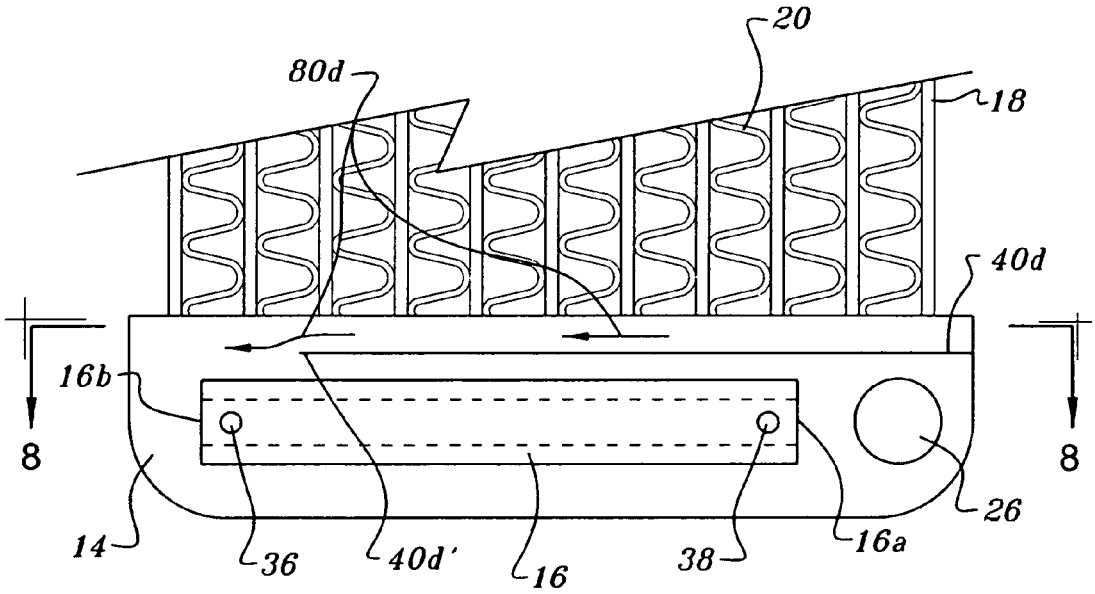
FIG. 7 is a front elevational view, partially in section, of the lower portion of the radiator of FIG. 1 showing a second embodiment of the preferred oil cooler, baffle and radiator combination of the present invention.
Figure 8:
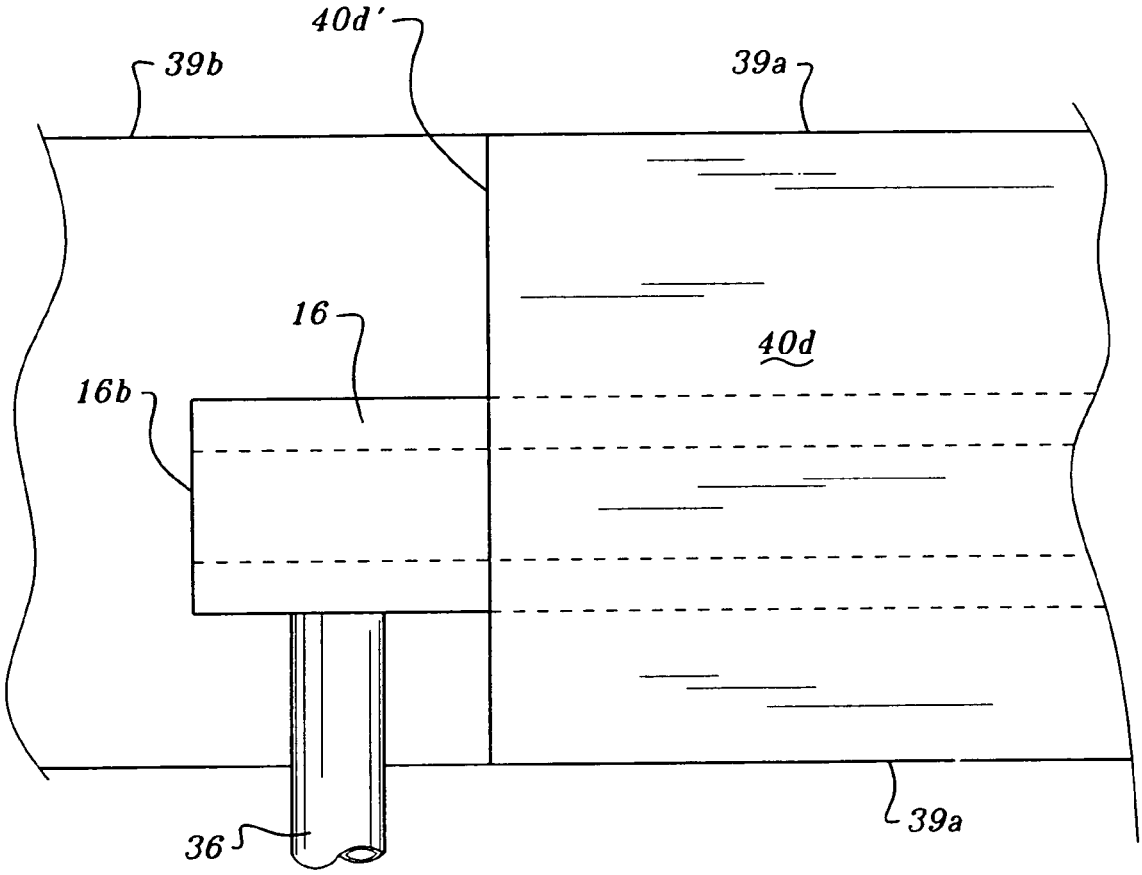
FIG. 8 is a top down sectional view, along lines 8-8 of FIG. 7, of the second embodiment oil cooler and baffle mounted in the radiator outlet tank.

Referring to FIGS. 7 and 8, in another embodiment of the oil cooler and radiator system of the present invention, the baffle 40*d* is an elongated planar plate positioned approximately mid-way between the oil cooler and core tube ends, substantially parallel to the wall of the outlet tank 14 where the core tubes 18 are attached. The baffle extends along a portion of the tube 18 openings along the length of the outlet tank, and extends completely across the outlet tank from the front wall 39*a* to the rear wall 39*b*. The length of baffle 40*d* extends from the end of the outlet tank where the coolant outlet 26 is located and overlaps a portion of the oil cooler, to a point 40*d*' between the ends 16*a*, 16*b* of the oil cooler, closer to the end opposite the tank outlet 26.

In operation, baffle 40*d* guides substantially the entire flow of coolant 80*d* in a direction toward the end 16*b* of the oil cooler opposite the coolant outlet 26. The coolant then flows in the opposite direction, toward outlet 26, and divides between a portion that flows on the outside of the oil cooler along the outer wall 32 and a portion that flows through the interior aperture of the oil cooler along the inner wall 34. The coolant then flows to the coolant outlet 26 and out of the system. Placement of the end 40*d*' and oil cooler adjust the flow proportions and allow for maximized heat transfer from the oil cooler to the coolant, and may be determined without undue experimentation.

Figure 9:
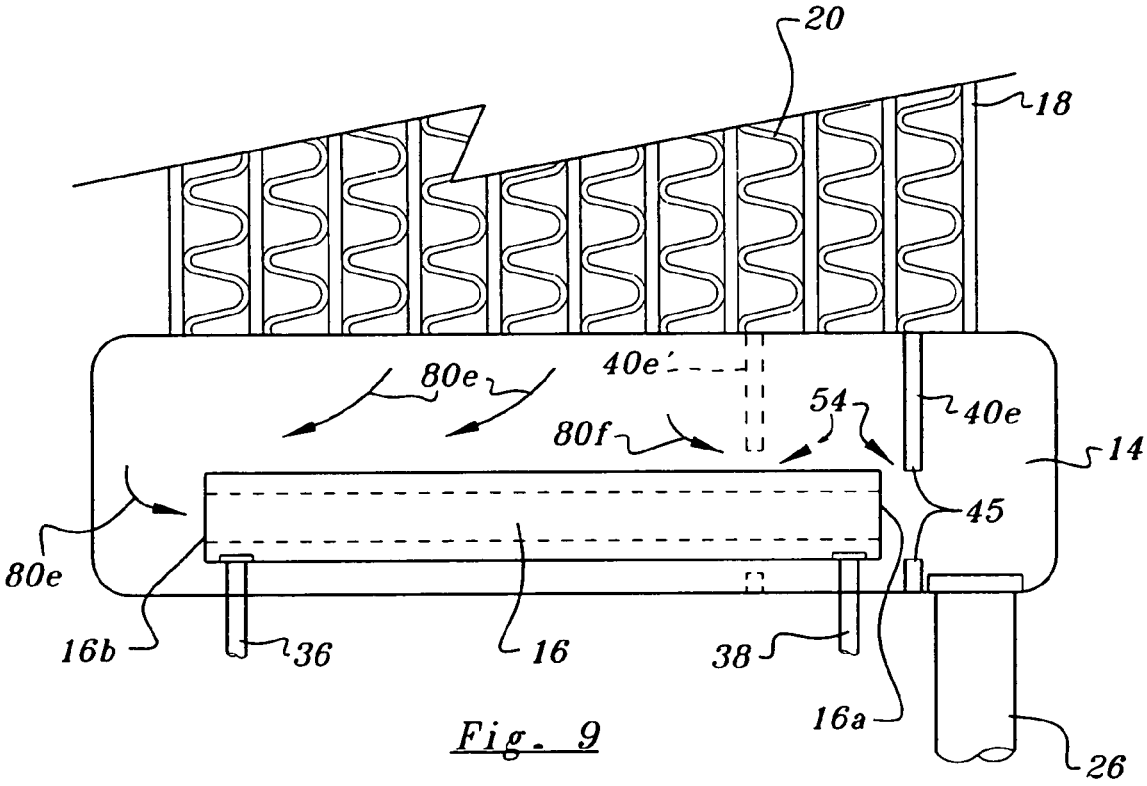
FIG. 9 is a top down sectional view of the outlet tank of the radiator of FIG. 1 showing a third embodiment of the preferred oil cooler, baffle and radiator combination of the present invention.
Figure 10:
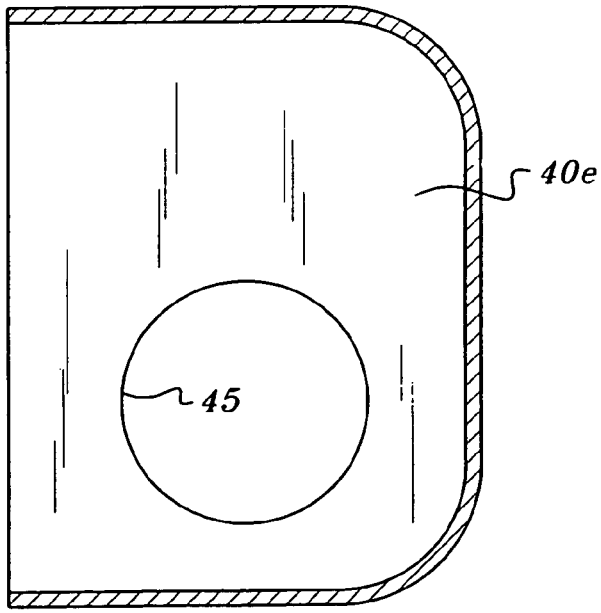
FIG. 10 is a side elevational view of the oil cooler baffle shown in FIG. 9.

Referring to FIGS. 9 and 10, in a further embodiment of the oil cooler and radiator tank system of the present invention, baffle 40*e* is of substantially the same configuration as the baffle 40 of the first embodiment of FIGS. 1-3, but is spaced from the oil cooler so that a gap 54 is created between the oil cooler and the baffle opening 45. In the embodiment of FIG. 9, the baffle 40*e* and opening 45 are disposed beyond the end of the oil cooler, between end 16*a* and coolant outlet 26. The baffle opening may be larger, the same size, or smaller than the outer diameter of oil cooler 16. In this embodiment, the baffle 40*e* may be one piece and integral with the outlet tank since it does not affect the installation or removal of the oil cooler 16.

Alternatively, the baffle may have an opening of size greater than the oil cooler outer diameter, and may be located between the ends 16*a*, 16*b* of the oil cooler, as shown by baffle 40*e*' in phantom lines in FIG. 9. Again gap 54 is present between the baffle opening and the oil cooler outer wall.

Figure 11:
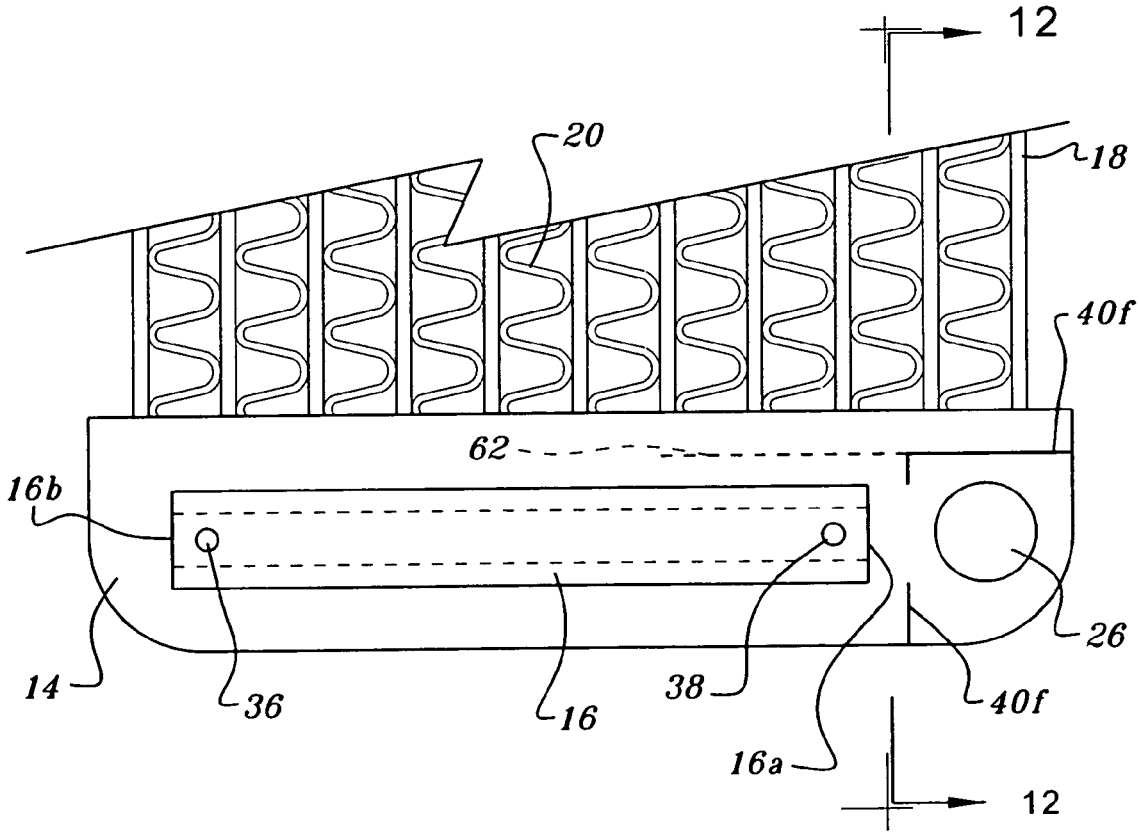
FIG. 11 is a front elevational view, partially in section, of the lower portion of the radiator of FIG. 1 showing a baffle modification in the third embodiment of the preferred oil cooler and radiator combination of the present invention.
Figure 12:
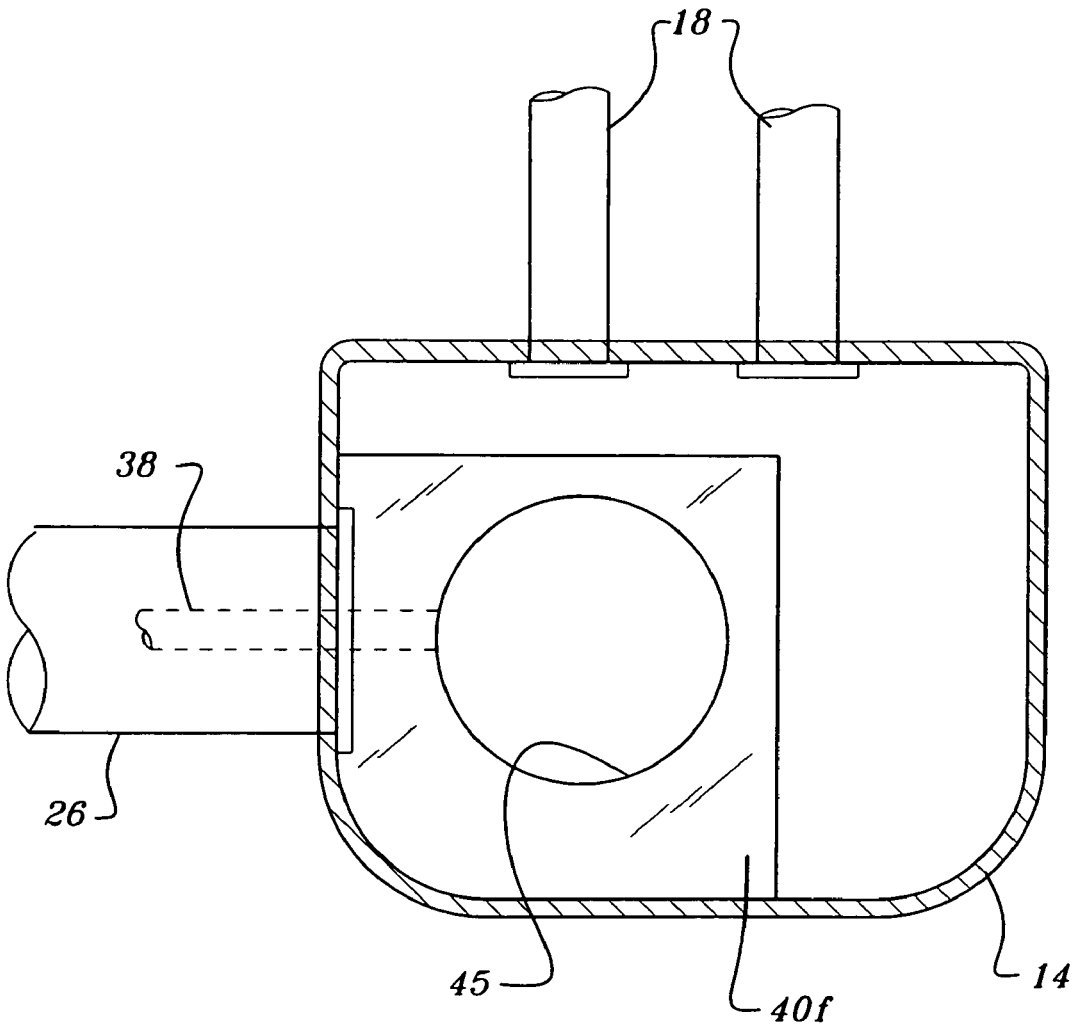
FIG. 12 is a left side sectional view, along lines 12-12 of FIG. 11, of the modified third embodiment oil cooler mounted in the radiator outlet tank.

FIGS. 11 and 12 show a modification of the embodiment of FIG. 9, where baffle 40*f* is in the form of a box around the coolant outlet 26 at end of outlet tank 14 with a baffle opening 45 spaced from the end 16*a* of the oil cooler and sized in the same manner as the opening of baffle 40*e*. The coolant outlet 26 is completely surrounded so no coolant may enter except through the opening 45 of the baffle 40*f* adjacent to the oil cooler end 16*a* closest to the coolant outlet 26. This baffle 40*f* may include a planar extended portion 62 as shown in FIG. 11, which extends horizontally between the oil cooler and core tube openings toward the center of the outlet tank 14 in the same manner as baffle 40*d*. Baffle 40*f* may also have an opening larger than the oil cooler diameter positioned between the ends 16*a*, 16*b* of the oil cooler, in the manner of baffle 40*e*'.

Figure 13:
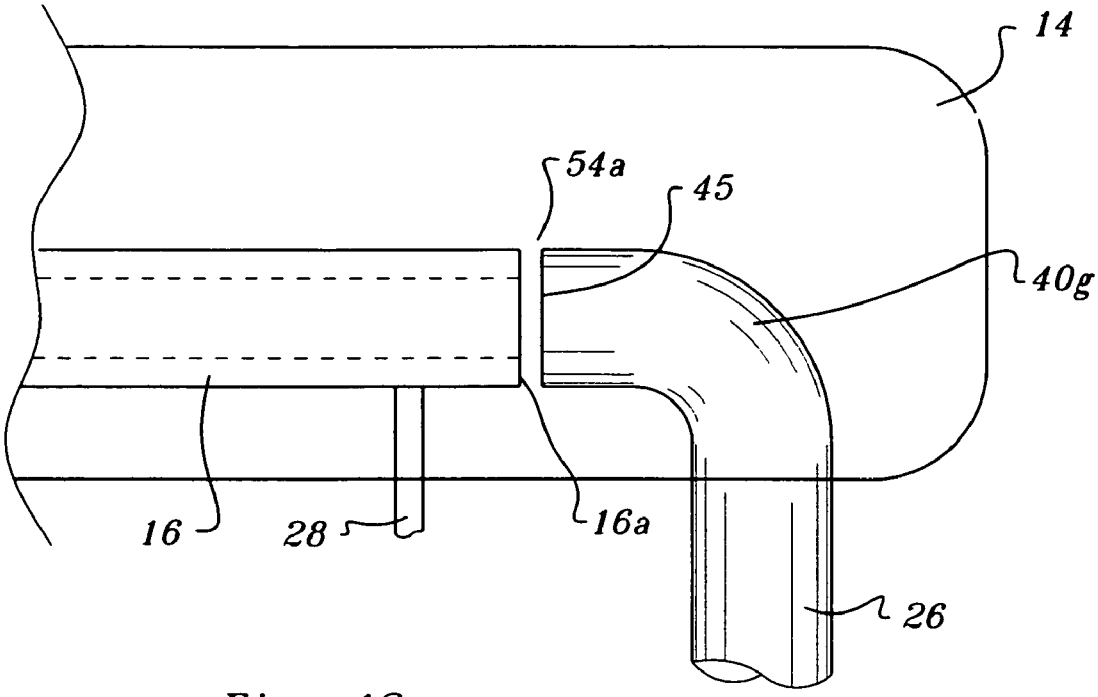
FIG. 13 is a top down sectional view of the end of the lower radiator tank of FIG. 1 showing still another baffle modification in the third embodiment of the preferred oil cooler and radiator combination of the present invention.
Figure 14:
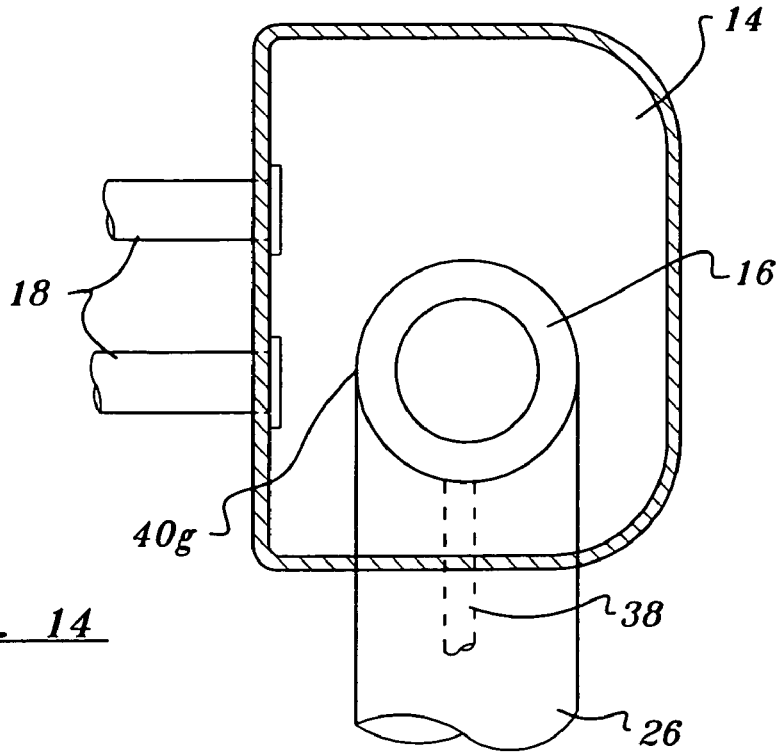
FIG. 14 is a right side sectional view of the outlet tank and baffle shown in FIG. 13.

In a further modification of this embodiment of the invention, as shown in FIGS. 13 and 14, baffle 40*g* is a tube extending from the coolant outlet. Baffle tube 40*g* includes a bend of substantially 90 degrees from coolant outlet 26 which extends the baffle tube so that it is substantially axially aligned with the end of the oil cooler. The baffle outlet opening 45 is sized and positioned to leave a gap between the outlet opening and end 16*a* of the oil cooler in the manner of baffle 40*e*. Alternately, the baffle opening 45 may be larger than the oil cooler diameter and extend over and beyond the end 16*a* of the oil cooler 16, so that the baffle opening 45 is between the ends 16*a*, 16*b* of the oil cooler in the manner of baffle 40*e*'.

In operation of the embodiment and modifications of FIGS. 9-14, the coolant flows from coolant tubes 18 into the outlet tank. A portion of the coolant passes over the exterior of the outer wall 32 of the oil cooler 16 towards cooler end 16*b* (as shown by arrows 80*e*), through the interior aperture and along the inner wall 34 of the oil cooler, through the baffle opening 45 to the coolant outlet 26. The remaining portion of the coolant from tubes 18 flows along the exterior of outer wall 32 of the oil cooler 16 towards the cooler end 16*a* (as shown by arrow 80*f*), through the gap 54 between the baffle opening 45 and oil cooler 16, and then through the baffle opening 45 to the coolant outlet 26.

The ratio of the amount of flow in the two coolant portions is determined by the size of the baffle opening 45 and the gap 54. As the baffle opening 45 and/or gap 54 are made larger, less coolant flow will be forced to flow through the interior aperture of the oil cooler. The sizes of baffle opening 45 and gap 54 are chosen to provide an optimum coolant flow through the interior aperture of the oil cooler; that is, a flow rate which will provide sufficient turbulation to provide maximum heat transfer without excessive coolant pressure drop. These sizes may be determined without undue experimentation. If baffle extension 62 (FIG. 11) is provided, more coolant is forced towards cooler end 16*b*, through the inner aperture and along inner wall 34.

Thus, the present invention provides a baffle for a concentric oil cooler in a radiator tank that improves circulation of coolant in the tank to cool the oil flowing through the oil cooler. Moreover, the baffle and concentric oil cooler combination of the present invention may be easily assembled in a radiator tank and that provides cost savings in manufacture.

While the present invention has been particularly described, in conjunction with a specific preferred embodiment, it is evident that many alternatives, modifications and variations will be apparent to those skilled in the art in light of the foregoing description. For example, the oil cooler embodiments of the present invention may be disposed in the inlet tank 12 in the same manner as described above in connection with the outlet tank, except that the coolant outlet becomes the coolant inlet, and all of the coolant flows are reversed from the directions described in the specification and shown in the drawing figures. In this modification, the engine coolant used to cool the oil in the oil cooler is hotter than when the oil cooler is disposed in the outlet tank, since it has not yet been cooled by passage through the radiator core. It is therefore contemplated that the appended claims will embrace any such alternatives, modifications and variations as falling within the true scope and spirit of the present invention.

Thus, having described the invention, what is claimed is:

1. A radiator and oil cooler combination for an internal combustion engine comprising:

an outlet radiator tank having an engine coolant outlet at an end thereof, the radiator tank being connected along a side thereof to radiator core tubes, openings of the tubes extending along a length of the outlet radiator tank side, the radiator tank permitting coolant flow entering from the radiator core tubes to pass through the coolant outlet;

an oil cooler within the outlet radiator tank and away from the engine coolant outlet comprising inner and outer concentric tubes sealed to each other at opposite ends thereof, one end of the oil cooler being closer to the engine coolant outlet than the other end of the oil cooler, with fluid connections through the outer concentric tube to allow oil to enter and exit the oil cooler, whereby oil may flow in the oil cooler between the inner and outer tubes, and the coolant may flow along an outer wall of the outer tube and through the inside of the inner concentric tube along an inner wall thereof; and a baffle located in the outlet radiator tank near the end the end of the oil cooler closer to the engine coolant outlet, the baffle being between the engine coolant outlet and the end of the oil cooler farther from the engine coolant outlet, the baffle having an opening spaced from the oil cooler outer wall whereby the spacing between the baffle opening and the outer wall restricts coolant flow therethrough so as to permit a portion of the coolant entering from the radiator core tubes to pass between the oil cooler and the opening and out the coolant outlet while forcing the other portion of the coolant entering from the radiator core tubes to flow away from the baffle opening, along the oil cooler outer wall and through the inside of the inner concentric tube along the inner wall and out the baffle opening and coolant outlet.

2. The radiator and oil cooler combination of claim 1 wherein the baffle comprises a plate located between the tank engine cooling outlet and the end of the oil cooler closer to the engine coolant outlet.

3. The radiator and oil cooler combination of claim 2 wherein the baffle opening is smaller than a diameter of the oil cooler.

4. The radiator and oil cooler combination of claim 2 wherein the baffle opening is the same size or larger than an outer diameter of the oil cooler.

5. The radiator and oil cooler combination of claim 1 wherein the baffle comprises a plate located between the ends of the oil cooler, with the baffle opening being larger than an outer diameter of the oil cooler.

6. A method of cooling an oil cooler in a radiator and oil cooler combination for an internal combustion engine comprising:

providing an outlet radiator tank having an engine coolant outlet at an end thereof, the radiator tank being connected along a side thereof to radiator core tubes, openings of the tubes extending along a length of the outlet radiator tank side, the radiator tank permitting coolant flow entering from the radiator core tubes to pass through the coolant outlet;

providing an oil cooler within the outlet radiator tank and away from the engine coolant outlet comprising inner and outer concentric tubes sealed to each other at opposite ends thereof, one end of the oil cooler being closer to the engine coolant outlet than the other end of the oil cooler, with fluid connections through the outer concentric tube to allow oil to enter and exit the oil cooler, whereby oil may flow in the oil cooler between the inner and outer tubes, and the coolant may flow along an outer wall of the outer tube and through the inside of the inner concentric tube along an inner wall thereof;

providing a baffle located in the outlet radiator tank near the end of the oil cooler closer to the engine coolant outlet, the baffle being between the engine coolant outlet and the end of the oil cooler farther from the engine coolant outlet, the baffle having an opening spaced from the oil cooler outer wall;

flowing oil through the oil cooler; and flowing engine coolant from the radiator core tubes to the radiator tank, whereby the spacing between the baffle opening and the outer wall restricts coolant flow therethrough so as to permit a portion of the coolant entering from the radiator core tubes to pass between the oil cooler and the opening and out the coolant outlet while forcing the other portion of the coolant entering from the radiator core tubes to flow away from the baffle opening, along the oil cooler outer wall and through the inside of the inner concentric tube along the inner wall and out the baffle opening and coolant outlet.

7. The method of claim 6 wherein the baffle comprises a plate located between the tank engine cooling outlet and the end of the oil cooler closer to the engine coolant outlet.

8. The method of claim 6 wherein the baffle opening is smaller than a diameter of the oil cooler.

9. The method of claim 6 wherein the baffle opening is the same size or larger than an outer diameter of the oil cooler.

10. The method of claim 6 wherein the baffle comprises a plate located between the ends of the oil cooler, with the baffle opening being larger than an outer diameter of the oil cooler.

11. A radiator and oil cooler combination for an internal combustion engine comprising:

an inlet radiator tank having an engine coolant inlet at an end thereof, the radiator tank being connected along a side thereof to radiator core tubes, openings of the tubes extending along a length of the inlet radiator tank side, the radiator tank permitting coolant flow entering from the radiator tank inlet to pass through the radiator tank to the radiator core tubes;

an oil cooler within the inlet radiator tank and away from the engine coolant inlet comprising inner and outer concentric tubes sealed to each other at opposite ends thereof, one end of the oil cooler being closer to the engine coolant inlet than the other end of the oil cooler, with fluid connections through the outer concentric tube to allow oil to enter and exit the oil cooler, whereby oil may flow in the oil cooler between the inner and outer tubes, and the coolant may flow along an outer wall of the outer tube and through the inside of the inner concentric tube along an inner wall thereof; and a baffle located in the inlet radiator tank near the end of the oil cooler closer to the engine coolant inlet, the baffle being between the engine coolant inlet and the end of the oil cooler farther from the engine coolant inlet, the baffle having an opening spaced from the oil cooler outer wall whereby the spacing between the baffle opening and the outer wall restricts coolant flow therethrough so as to permit a portion of the coolant entering from the radiator tank engine coolant inlet to pass between the oil cooler and the opening, along the oil cooler outer wall and out the radiator core tubes while forcing the other portion of the coolant entering from the radiator tank engine coolant inlet to flow through the inside of the inner concentric tube along the inner wall and out the radiator core tubes.

12. The radiator and oil cooler combination of claim 11 wherein the baffle comprises a plate located between the tank engine cooling outlet and the end of the oil cooler closer to the engine coolant outlet.

13. The radiator and oil cooler combination of claim 11 wherein the baffle opening is smaller than a diameter of the oil cooler.

14. The radiator and oil cooler combination of claim 11 wherein the baffle opening is the same size or larger than an outer diameter of the oil cooler.

15. The radiator and oil cooler combination of claim 11 wherein the baffle comprises a plate located between the ends of the oil cooler, with the baffle opening being larger than an outer diameter of the oil cooler.

16. A method of cooling an oil cooler in a radiator and oil cooler combination for an internal combustion engine comprising:

providing an inlet radiator tank having an engine coolant inlet at an end thereof, the radiator tank being connected along a side thereof to radiator core tubes, openings of the tubes extending along a length of the inlet radiator tank side, the radiator tank permitting coolant flow entering from the radiator tank inlet to pass through the radiator tank to the radiator core tubes;

providing an oil cooler within the inlet radiator tank and away from the engine coolant inlet comprising inner and outer concentric tubes sealed to each other at opposite ends thereof, one end of the oil cooler being closer to the engine coolant inlet than the other end of the oil cooler, with fluid connections through the outer concentric tube to allow oil to enter and exit the oil cooler, whereby oil may flow in the oil cooler between the inner and outer tubes, and the coolant may flow along an outer wall of the outer tube and through the inside of the inner concentric tube along an inner wall thereof;

providing a baffle located in the inlet radiator tank near the end of the oil cooler closer to the engine coolant inlet, the baffle being between the engine coolant inlet and the end of the oil cooler farther from the engine coolant inlet, the baffle having an opening spaced from the oil cooler outer wall;

flowing oil through the oil cooler; and flowing engine coolant from the radiator tank inlet to the radiator core tubes, whereby the spacing between the baffle opening and the outer wall restricts coolant flow therethrough so as to permit a portion of the coolant entering from the radiator tank engine coolant inlet to pass between the oil cooler and the opening, along the oil cooler outer wall and out the radiator core tubes while forcing the other portion of the coolant entering from the radiator tank engine coolant inlet to flow through the inside of the inner concentric tube along the inner wall and out the radiator core tubes.

17. The method of claim 16 wherein the baffle comprises a plate located between the tank engine cooling outlet and the end of the oil cooler closer to the engine coolant outlet.

18. The method of claim 16 wherein the baffle opening is smaller than a diameter of the oil cooler.

19. The method of claim 16 wherein the baffle opening is the same size or larger than an outer diameter of the oil cooler.

20. The method of claim 16 wherein the baffle comprises a plate located between the ends of the oil cooler, with the baffle opening being larger than an outer diameter of the oil cooler.

* * * * *